US007722276B2

(12) United States Patent
Gueret

(10) Patent No.: US 7,722,276 B2
(45) Date of Patent: May 25, 2010

(54) APPLICATOR DEVICE FOR APPLYING A SUBSTANCE

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 1011 days.

(21) Appl. No.: 11/253,549

(22) Filed: Oct. 20, 2005

(65) Prior Publication Data

US 2006/0083577 A1 Apr. 20, 2006

Related U.S. Application Data

(60) Provisional application No. 60/628,534, filed on Nov. 18, 2004.

(30) Foreign Application Priority Data

Oct. 20, 2004 (FR) ..... 04 52378

(51) Int. Cl.
*B43K 5/00* (2006.01)

(52) U.S. Cl. ..... 401/206; 401/205

(58) Field of Classification Search ..... 401/203, 401/205, 206, 207, 196, 198, 199
See application file for complete search history.

(56) References Cited

U.S. PATENT DOCUMENTS 3,084,375 A * 4/1963 Schwartzman ..... 401/206
3,129,452 A 4/1964 Schwartzman
3,565,294 A * 2/1971 Schwartzman ..... 222/107
5,064,306 A * 11/1991 Gueret ..... 401/133
5,492,426 A 2/1996 Gueret
5,636,931 A 6/1997 Gueret
6,883,995 B1 4/2005 Gueret
2002/0127046 A1 9/2002 Gueret
2002/0172541 A1 11/2002 Gueret
2003/0129016 A1 7/2003 Gueret

FOREIGN PATENT DOCUMENTS

DE 39 38 347 A1 5/1991
FR 2 800 041 B1 4/2001
JP S-54-77742 6/1979
JP A-06-296520 10/1994
JP A-2001-161436 6/2001

* cited by examiner

*Primary Examiner*—David J Walczak
(74) *Attorney, Agent, or Firm*—Oliff & Berridge, PLC

(57) ABSTRACT

An applicator device for applying a substance may include: an inside space containing a supply of substance; an applicator member including a cellular material that deforms at least in part during application, and an application surface configured to apply the substance; a handle that is secured to the applicator member which includes at least one portion that is fastened relative to the handle; a housing configured to receive the applicator member at least in part, the housing communicating in a permanent manner with the inside space containing the supply of substance; and a resilient return member configured to exert thrust on the applicator member toward the application surface.

39 Claims, 4 Drawing Sheets

APPLICATOR DEVICE FOR APPLYING A SUBSTANCE

This non-provisional application claims the benefit of French Application No. 04 52378 filed on Oct. 20, 2004, and U.S. Provisional Application No. 60/628,534 filed on Nov. 18, 2004, the entire disclosures of which are incorporated herein by reference.

The present invention relates to an applicator device for applying a substance, for example, a cosmetic or a skincare product.

The term "cosmetic substance" as used in the context of the present invention means a substance as defined in the Jun. 14, 1993 EEC Directive 93/35 modifying EEC Directive 76/768.

BACKGROUND

French patent FR 2 800 041 discloses a packaging and applicator device including an applicator member fastened on a spring support. The spring support has compressibility that is greater than the compressibility of the applicator member, so that the spring support compensates for the applicator member being compressed excessively, thereby preventing too much substance from being expelled, where necessary.

U.S. Patent Application Publication No. 2003/0129016 discloses an applicator device including a block of foam that has thinner zones making it possible to increase compressibility of the block of foam. The block of foam may be covered by a skin of stiff plastics material or elastomer.

European patent application EP 1 230 869 discloses an applicator comprising a first block of foam having a tubular shape, inside which a second block of foam is disposed, the second block of foam being stiffer than the first block of foam.

Finally, U.S. Pat. No. 3,129,452 discloses an applicator including a multilayer structure defining an application surface. An element made of polyurethane foam is disposed beneath the multilayer structure so as to impart a convex shape thereto. A valve is provided for the purpose, when the applicator is not in use, of closing a passage through which the substance flows toward the application surface when the applicator is in use.

Like the exemplary applicator device described in U.S. Patent Application Publication No. 2003/0129016, some applicator devices include an applicator member that is compressed by a closure cap during storage.

SUMMARY

In the long term, such compression may reduce the ability of the applicator member to return to an initial shape thereof.

Such a decrease in the elasticity of the applicator member may be particularly troublesome when the substance which is applied thereby affects the shape memory properties of the applicator member, for example, because of relatively high viscosity and/or because of the presence in the substance of certain compounds, such as polymers, that are capable of stiffening the applicator member.

Such a drawback makes it inadvisable to use relatively flexible materials to make the applicator member, whereas such materials are desirable to offer a sensation of softness during application.

Exemplary embodiments of the invention seek to further improve devices including an applicator member that is deformable at least in part.

Exemplary embodiments of the invention may provide an applicator device for applying a substance, the device comprising: an inside space containing a supply of substance; an applicator member comprising a cellular material that deforms at least in part during application, and an application surface configured to apply the substance; a handle secured to the applicator member, the applicator member comprising at least one portion fastened relative to the handle; a housing configured to receive the applicator member at least in part, the housing communicating in a permanent manner with the inside space containing the supply of substance; and a resilient return member configured to exert thrust on the applicator member toward the application surface.

In exemplary embodiments, the thrust may be exerted at least when the applicator member is compressed to a certain degree during normal use and/or when the housing receiving the applicator member is closed.

In exemplary embodiments, the resilient return member may allow the applicator member to return to an initial shape thereof, for example, when the housing is opened, or after the applicator member has been pressed against a zone to be treated.

If desired, in exemplary embodiments the applicator member may be made of a fairly flexible material, such as a foam made of nitrile butadiene rubber (NBR), styrene butadiene rubber (SBR), polyurethane, or polyether, for example.

In exemplary embodiments in which the applicator member is porous and returns to a shape corresponding to a non-compressed state, pores of the applicator member may tend to expand, thereby making it easier to load the applicator member with substance, and thereby increasing flexibility of the applicator member.

In addition, the resilient return member, for example, in exemplary embodiments in which the resilient return member is disposed at least in part in a recess of the applicator member, may be configured to assist in holding the applicator member on a support thereof. Where appropriate or desired, this may simplify fastening the applicator member onto a remainder of the device.

In exemplary embodiments, at least part of the applicator member may be elastically deformable, and, for example, may be elastically compressible.

In exemplary embodiments, the application surface and the portion of the applicator member that is secured relative to the handle may be configured so as to become closer to each other while the applicator member is being compressed in use and/or when the housing receiving the applicator member is closed.

In exemplary embodiments, the resilient return member may be compressed when the applicator member is not in use and when the housing is open.

In exemplary embodiments, the resilient return member may be configured to work in compression.

In exemplary embodiments, the resilient return member may comprise a spring, such as a helical spring, for example, a single or double helix, with turns that optionally touch when the housing is closed. In other exemplary embodiments, the spring may comprise a conical spring or may be in the shape of bellows, this list not being limiting. The spring may be made of metal and/or plastics material, for example.

In exemplary embodiments, the resilient return member may comprise a cellular material, such as a foam, which may be permeable to the substance and which may include good ability to return to an initial shape thereof.

In exemplary embodiments, the resilient return member and the applicator member may be made of different materials, the applicator member being made of a material that imparts softness during application. The resilient return member may advantageously include the ability to return to an initial shape thereof after the member has been compressed to a greater degree than the applicator member.

In exemplary embodiments in which the device includes a support carrying the applicator member, the resilient return member may be fastened on said support. In other exemplary embodiments in which the device includes a support carrying the applicator member, the resilient return member may be made integrally as a single piece with said support, for example, by molding plastics material, so that the device includes a smaller number of parts.

In exemplary embodiments, the resilient return member may include biocidal properties. Such properties may be linked, for example, to the presence in and/or on the resilient return member of metallic salts, for example, silver, aluminum, or copper salts, or ferric oxides. Thus, an amount of preservatives in the substance may thus be reduced, where appropriate or desired.

In exemplary embodiments, the device may include a closure cap configured to close the housing. The cap may be configured to optionally compress the applicator member when the housing is closed by the cap. For example, the cap may be configured to compress the applicator member, at least in part, when the housing is closed by the cap at least in part.

In exemplary embodiments in which the cap does not compress the applicator member in the closed position, the resilient return member may nevertheless be useful for returning the applicator member into an initial configuration thereof after the applicator member has been squeezed against a zone to be treated.

In exemplary embodiments, the receptacle of the device may define the inside space containing the supply of substance. In such exemplary embodiments, the receptacle may further define the handle secured to the applicator member.

In exemplary embodiments, the receptacle may include a support carrying the applicator member. The support may advantageously include at least one orifice configured to enable substance to pass from the inside space to the applicator member.

For example, the receptacle need not include a valve associated with said orifice.

In exemplary embodiments, the support may include a chimney communicating with the orifice and extending at least in part into the housing that receives the applicator member.

In exemplary embodiments, the chimney may be configured to serve as a guide to the resilient return member.

In exemplary embodiments, the chimney may form an annular space in a recess of the applicator member, with the resilient return member extending at least partially in said annular space.

In exemplary embodiments in which the resilient return member comprises a spring, said spring may be disposed around the orifice and may include an inside diameter that is substantially equal to a diameter of said orifice. In other exemplary embodiments, the inside diameter of the spring may be greater than the diameter of the orifice. In other exemplary embodiments, the inside diameter of the spring may be greater than an outside diameter of the chinney.

In exemplary embodiments, the closure cap may define the handle secured to the applicator member.

In exemplary embodiments in which the device includes a receptacle containing a supply of substance, the receptacle may include a perforated wall that defines the housing in which the applicator member is received at least in part. The perforated wall may include one or a plurality of orifices.

In exemplary embodiments in which the applicator member is secured to the closure cap, said closure cap may be loaded with substance merely by disposing the applicator member in the housing of the receptacle, without having to fasten the cap onto the receptacle, for example, by screw-fastening or snap-fastening. The resilient return member may be configured to enable the applicator member to return, in the non-compressed state, to a relatively tall height, for example, taller than a depth of the housing of the receptacle.

In exemplary embodiments, the applicator member may comprise a foam, and the applicator member may be intrinsically permeable to the substance. The applicator member may optionally include at least one through orifice, for example, a slot or a hole, that opens to the application surface so as to make it easier for the substance to arrive thereon.

In exemplary embodiments, the applicator member may be a single piece. In other exemplary embodiments, the applicator member may comprise different materials.

In exemplary embodiments, the applicator member may include a recess including an end wall, the resilient return member being configured to exert thrust on the end wall toward the application surface.

In exemplary embodiments, the recess may include a wall having a shape selected from: a cylindrical shape, a frusto-conical shape, a conical shape, a truncated spherical shape, or a rounded shape, for example, substantially an egg shape.

In exemplary embodiments in which the resilient return member comprises a cellular material, the resilient return member may comprise a tubular wall that may extend over substantially an entire height of the recess, for example.

In exemplary embodiments, the resilient return member may be in permanent contact with the applicator member and/or may extend at least in part into the recess of the applicator member.

Where appropriate or desired, the applicator member may include at least one groove, for example, an annular groove, that extends substantially transversally to a direction in which the applicator member is compressed in use. The groove may form a preferred compression zone making it possible to prevent the applicator member from being over compressed, and thereby preventing too much substance from being expelled.

In a non-compressed state thereof, the applicator member may comprise various forms, for example, including a height that is greater than a largest transverse dimension thereof.

In exemplary embodiments, the resilient return member may optionally be fastened to the applicator member.

In exemplary embodiments in which the device includes a support carrying the applicator member, the support may include an outer skirt, for example, a skirt configured to co-operate in a sealing manner with a closure cap and surrounding the applicator member at least in part. In a non-compressed state, the applicator member may include a height that is greater than a height of the skirt, for example, at least 2% greater, at least 5% greater at least 10% greater, or even at least 20% greater.

Because in exemplary embodiments the resilient return member allows the applicator member to return to an initial shape thereof after the resilient return member has been compressed, the application surface may be located, at the moment of application, relatively far from a he top edge of the skirt. Thus, while the applicator member is being compressed against a zone to be treated to apply the substance, the top edge of the skirt need not come into contact with said zone, thereby increasing comfort in application.

In exemplary embodiments, the applicator member in the compressed state, when the cap is closed, may include a height that is substantially equal to a height of the outer skirt which surrounds the applicator member. The height of the applicator member in the compressed state, when the cap is closed, may be reduced by at least 2%, for example, and in particular by at least 5%, 10%, or 20% compared to the height thereof in the non-compressed state.

In exemplary embodiments, the applicator member may comprise at a bottom portion an annular wall of thickness that decreases toward a bottom end of the applicator member.

In exemplary embodiments, the substance may comprise a cosmetic, for example, for applying to skin or for treating hair, or may comprise a skincare product.

In exemplary embodiments, the substance may include a polymer.

Exemplary embodiments of the invention may provide a cosmetic or skin treatment method comprising: providing an applicator device as defined above; loading the applicator member with substance; and applying the substance to a zone to be treated, foe example, to skin, using the applicator member, for example, by compressing the applicator member.

In exemplary embodiments in which the device comprises a receptacle and a cap configured to be fastened thereon, for example, by screw-fastening or snap-fastening, with the applicator member being secured to the cap, the applicator member may be loaded with substance without fastening the cap onto the receptacle.

Exemplary embodiments of the invention may provide an applicator device for applying a substance, the device comprising: an inside space containing a supply of substance; an applicator member that is deformable at least in part, and comprising: an application surface configured to apply the substance; and a recess including an end wall; a housing configured to receive the applicator member at least in part; a closure cap configured to close the housing, said housing communicating, when the closure cap is in a closed position, with the inside space containing the supply of substance; and a resilient return member configured to exert thrust on the end wall of the recess of the applicator member toward the application surface.

In exemplary embodiments, the resilient return member does not extend in the entire space formed by the recess.

For example, in exemplary embodiments in which the resilient return member comprises a cellular material, said cellular material may extend in a portion only of the space formed by the recess.

Exemplary embodiments of the invention may provide an applicator device for applying a substance, such as a cosmetic, the device comprising: an applicator member that is deformable at least in part, and comprising: an application surface configured to apply the substance; and a recess; and a spring, such as a helical spring, housed at least in part in the recess of the applicator member, and configured to exert thrust on the applicator member toward the application surface.

Exemplary embodiments of the invention may provide an applicator device for applying a substance, such as a cosmetic, the device comprising: an applicator member that is deformable at least in part, and comprising: an application surface configured to apply the substance; and a recess having a substantially cylindrical shape that is circularly cylindrical or not; and a resilient return member, such as a spring, for example, a helical spring, housed at least in part in the recess, and configured to exert thrust on the applicator member toward the application surface, for example, during relaxation of the resilient return member.

Exemplary embodiments of the invention may provide an applicator device for applying a substance, such as a cosmetic, the device comprising: an applicator member made of an elastically compressible cellular material, and comprising: an application surface configured to apply the substance; and a recess; a housing configured to receive the applicator member at least in part; a closure cap configured to close said housing at least when the applicator member is disposed in the housing; and a resilient return member, such as a spring comprising turns, for example, a helical or frustoconical spring, housed at least in part in the recess, and configured to exert thrust on the applicator member toward the application surface, for example, during relaxation of the resilient return member.

Exemplary embodiments of the invention may provide an applicator device for applying a substance, the device comprising: an applicator member that is deformable at least in part, and including an application surface configured to apply the substance; a housing configured to receive the applicator member at least in part to load the applicator member with substance; a closure cap arranged to close the housing, the applicator member being secured to the closure cap; and a resilient return member configured to exert thrust on the applicator member toward the application surface, for example, during relaxation of the resilient return member.

In exemplary embodiments in which the device comprises a receptacle containing a supply of substance, the housing may comprise a bottom wall fixed relative to the receptacle. For example, the housing may comprise a non-displaceable, for example, a non-slidable, wall, relative to the receptacle.

In exemplary embodiments, the volume of the housing closed by the closure member may be invariable, for example, independent from a quantity of product contained in the receptacle.

BRIEF DESCRIPTION OF THE DRAWINGS

Various details of the present invention may will be better understood on reading the following detailed description of non-limiting embodiments, and on examining the accompanying drawings, in which.

DETAILED DESCRIPTION OF EMBODIMENTS

Figure 1:
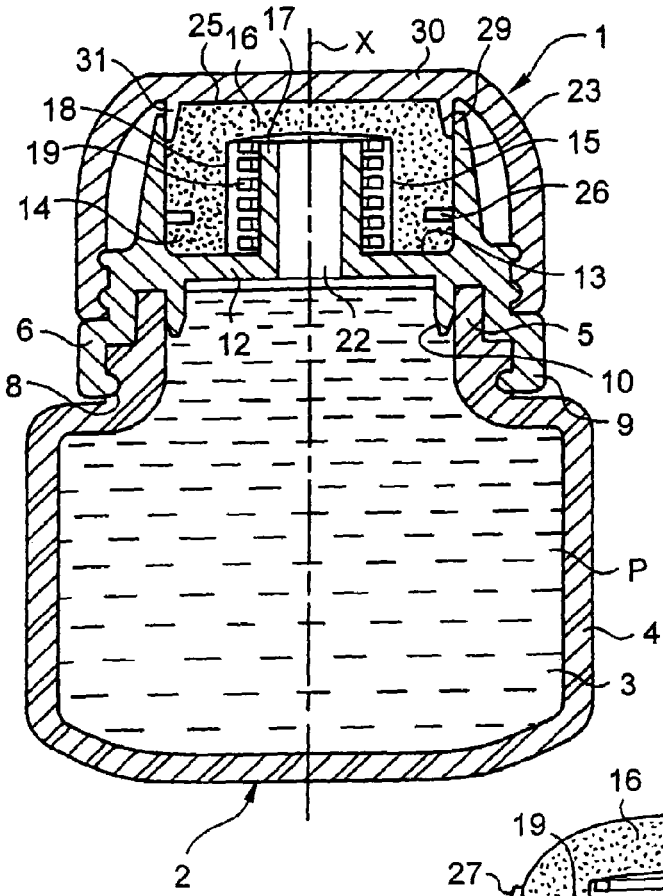
FIGS. 1 and 2 are diagrammatic and fragmentary axial-section views of an exemplary applicator device, respectively closed and open.

FIG. 1 shows an exemplary applicator device 1 including a receptacle 2 of axis X, including an inside space 3 containing a supply of substance P.

In the exemplary embodiment shown, the substance P may comprise a cosmetic or a skincare product for applying to skin. Alternatively or additionally, the substance P may comprise a haircare product. For example, the substance P may be a liquid or a powder.

The receptacle 2 may comprise a body 4 provided with a neck 5 of axis X, on which a support 6 may be fastened. In the exemplary embodiment shown, the neck 5 may include an annular groove 8 in which an assembly skirt 9 of the support 6 may be snap-fastened. Said support further may include a sealing lip 10 that comes to bear on an inside wall of the neck 5.

In the exemplary embodiment shown, the support 6 may include a transverse wall 12 that is substantially perpendicular to the axis X, and to which a bottom of an outer tubular skirt 23 may be connected.

The wall 12 and the outer skirt 23 may define a housing 29 in which an applicator member 14 may be secured. A bottom of the applicator member 14 may include an annular portion 13 that is positioned relative to the receptacle 2 and that is secured to the wall 12 by adhesive or heat sealing, for example.

The receptacle 2 may define a handle for the applicator member 14.

In the exemplary embodiment shown, the applicator member 14 may be made of compressible foam, for example, polyurethane, and may include a blind recess 15 opening to a bottom face thereof.

In the exemplary embodiment shown, the recess 15 may be substantially circularly cylindrical of axis X.

Alternatively, the recess may include a different shape, for example, a frustoconical shape, a truncated spherical shape, or a rounded shape, such as an egg shape.

A wall 16 of the recess 15, defining the end wall extending substantially transversally to the axis X, may close a top of the recess 15 and may also define at least a fraction of the application surface 25, for example, a top of the application surface 25.

In the exemplary embodiment shown consideration, the applicator member 14 may further include a peripheral annular groove 26 extending transversally to the axis X.

The support 6 may include a chimney 17, for example, a circularly-cylindrical chimney of axis X, extending into the recess 15 and communicating in a permanent manner with the inside space 3 via an orifice 22.

In the exemplary embodiment shown, the chimney 17 may be configured to serve as a guide to a resilient return member 19 extending into the annular space 18 formed around the chimney 17 in the recess 15.

In the exemplary embodiment shown, the resilient return member 19 may comprise a helical spring working in compression.

The spring 19 may be distinct from the support 6, being fastened thereon as shown, or may be made integrally as a single piece with said support (not shown).

The spring 19 may be made of plastics material or metal, and may possibly include biocidal properties, for example, by incorporating metallic salts, such as copper, silver, or aluminum salts, or ferric oxides.

In exemplary embodiments in which the spring 19 is made of plastics material, said plastics material may be be selected from the following non-limiting list: polypropylene (PP), polyethylene (PE), polyoxymethylene (POM), and polyethylene terephthalate (PET). Alternatively, the spring 19 may be made of elastomer, nitrile, latex, ethylene-propylene terpolymer rubber (EPDM), or some other material, such as thermoplastic, and may possibly include reinforcement.

The spring 19 may bear at a first end against the end wall 16 of the applicator member 14, and at a second end, remote from the first, against the support 6.

The applicator device 1 may include a closure cap 30 that is suitable for being fastened onto the support 6, for example, by snap-fastening or screw-fastening.

The cap 30 may include a sealing lip 31 that is configured to bear against an inside wall of the outer skirt 23 when the cap 30 is in the closed position, as shown in FIG. 1.

In the closed position, the applicator member 14 may be compressed and the height thereof may be substantially equal to the height of the outer skirt 23, for example. The spring 19 may also be compressed.

Figure 2:
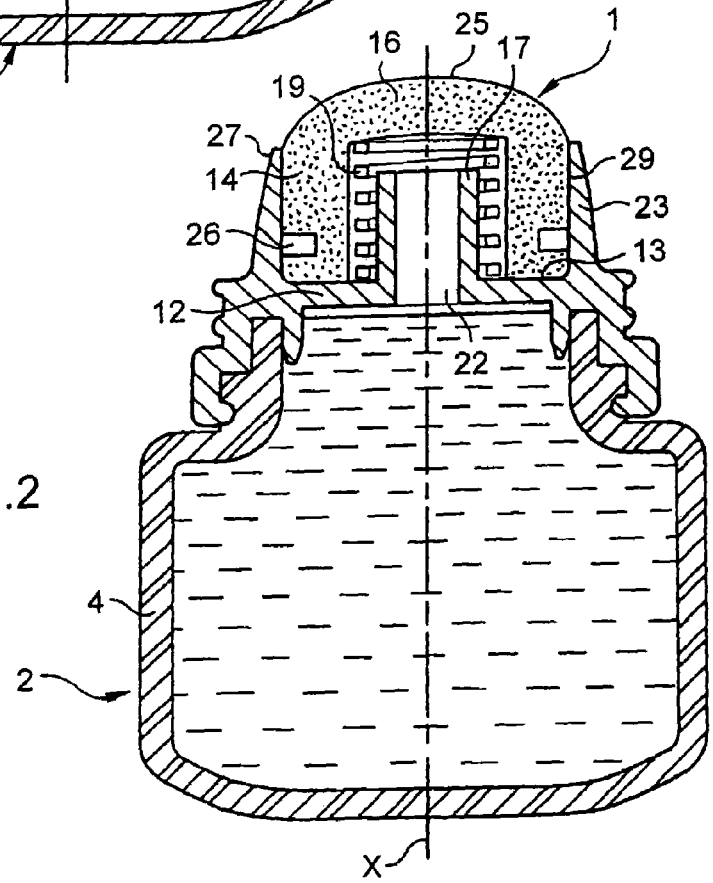

When the cap 30 is removed from the receptacle 2, as shown in FIG. 2, the applicator member 14 may relax and is allowed to expand under action of the spring 19, which bears against the end wall 16.

The applicator member 14 may be loaded with substance P by turning the device 1 upsidedown or by shaking the device 1 so that the substance P flows through the chimney 17 toward the applicator member 14. The body 4 may also include elastically deformable walls that enable the user to reduce a volume of the inside space 3 so as to cause the substance P to be expelled through the chimney 17. The receptacle 2 may also be fitted with a pump (not shown), which, when actuated, causes substance to be expelled toward the applicator member 14.

To apply substance P to skin, the user, after having loaded the applicator member 14 with substance, may bring the application surface 25 into contact with a region to be treated. During application, the applicator member 14 may be squeezed a little. When the device 1 is removed, the applicator member 14 may relax with the help of the spring 19.

At the moment of application, the application surface 25 may remain relatively far from the top edge 27 of the outer skirt 23, thereby preventing the skirt 23 from coming into contact with the skin.

In the exemplary embodiment shown, the bottom of the applicator member 14 that is adjacent to the secured portion 13 may include an annular wall with substantially constant thickness, as measured in a direction that is perpendicular to the axis X.

Figure 3:
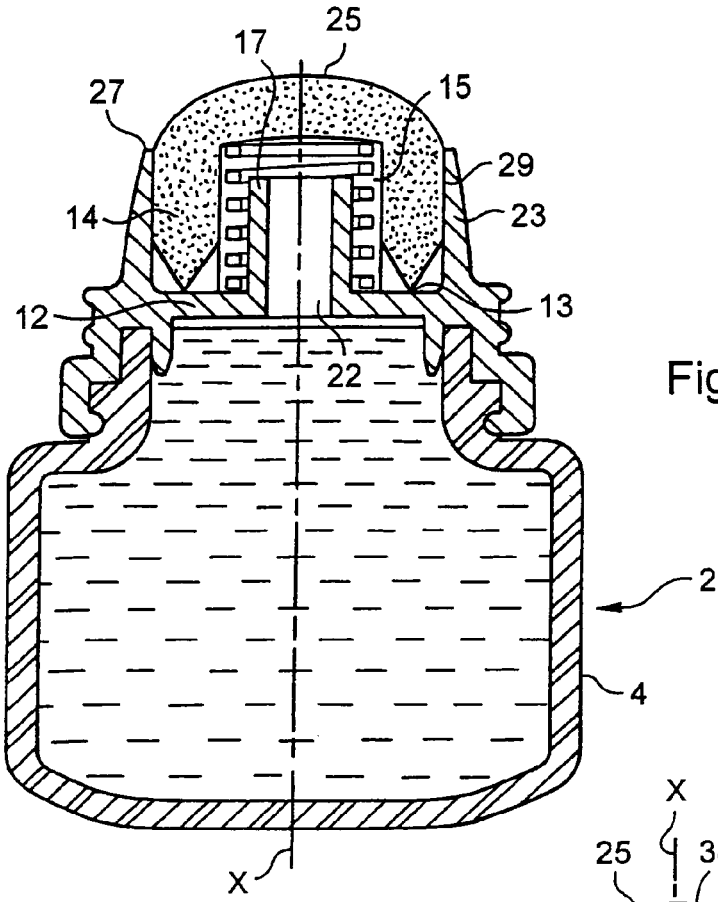
FIGS. 3 to 7 are diagrammatic and fragmentary axial-section views of other exemplary applicator devices.

In another exemplary embodiment, as shown in FIG. 3, the bottom of the applicator member 14 may include an annular wall of thickness, as measured in a direction that is perpendicular to the axis X, that decreases toward the stationary portion 13, thereby increasing the deformability of the applicator member in the axial direction.

The recess 15 may include a shape other than cylindrical.

Figure 4:
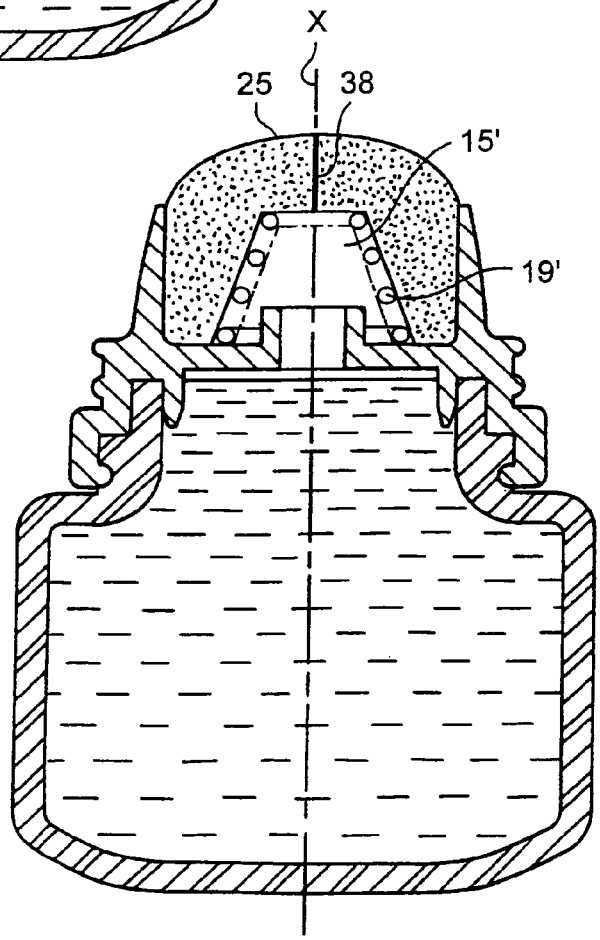

FIG. 4 shows an exemplary applicator element with a recess 15' including a frustoconical shape of axis X, housing a conical spring 19'.

In the exemplary embodiment shown, the applicator member 14 may include an orifice 38 passing therethrough, for example, a slot, so as to allow the substance to flow toward the application surface 25.

Figure 5:
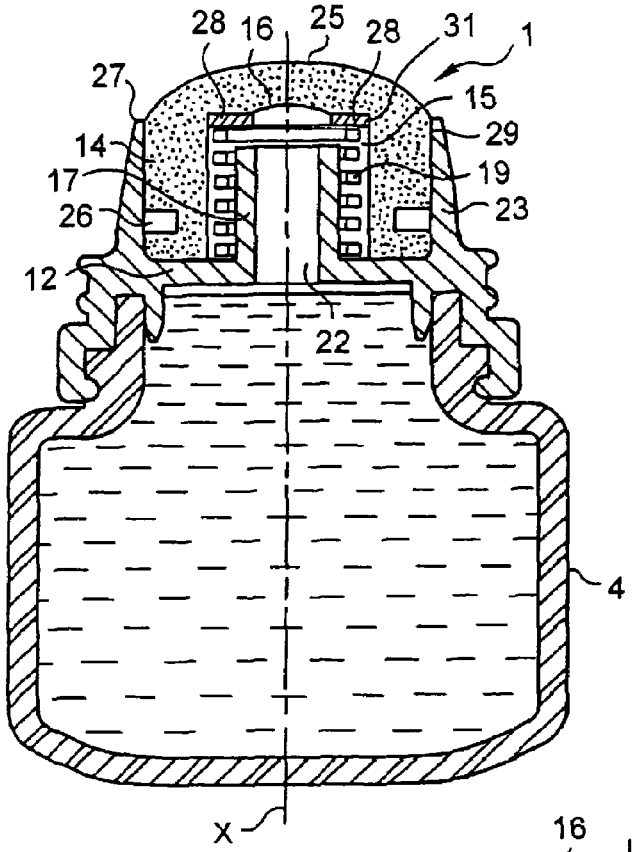

Naturally, such an orifice 38 need not exist in all embodiments.

Where appropriate or desired, the end wall 16 of the recess 15 may include a substantially planar annular shoulder 28 that is perpendicular to the axis X, as shown in FIG. 5. An insert 31 may be disposed against the shoulder 28, and the spring 19 may come to bear against said insert 31. If desired, the insert 31 may be made integrally as a single piece with the spring 19.

Figure 6:
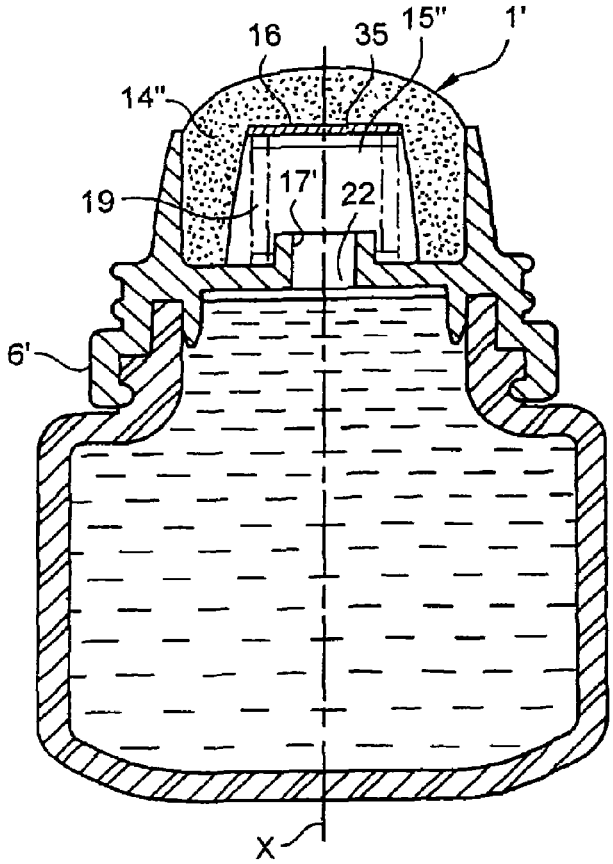

FIG. 6 shows an exemplary device 1' constituting another exemplary embodiment.

The device 1' may include a support 6' that differs from the above-described support 6 by the fact that the support 6' does not include a chimney 17 extending over a main portion of the height of the recess 15, the chimney 17 being omitted, for example, or as shown, being replaced by an annular rib 17' of small height.

In the exemplary embodiment shown in FIG. 6, the device 1' may include an applicator member 14" that differs from the above-described applicator member 14 by the fact that the applicator member 14" does not include a peripheral annular groove 26, and by the fact that applicator member 14" may include a recess 15" including a side wall with a rounded or truncated spherical shape, for example, an egg shape.

The exemplary device 1' may include a spring 19 that is no longer directly in contact with the applicator member 14 as in the exemplary device 1, but bears against an insert 35 disposed against the end wall 16 of the recess of the applicator member 14".

It is contemplated that the device may include a resilient return member other than a spring.

Figure 7:
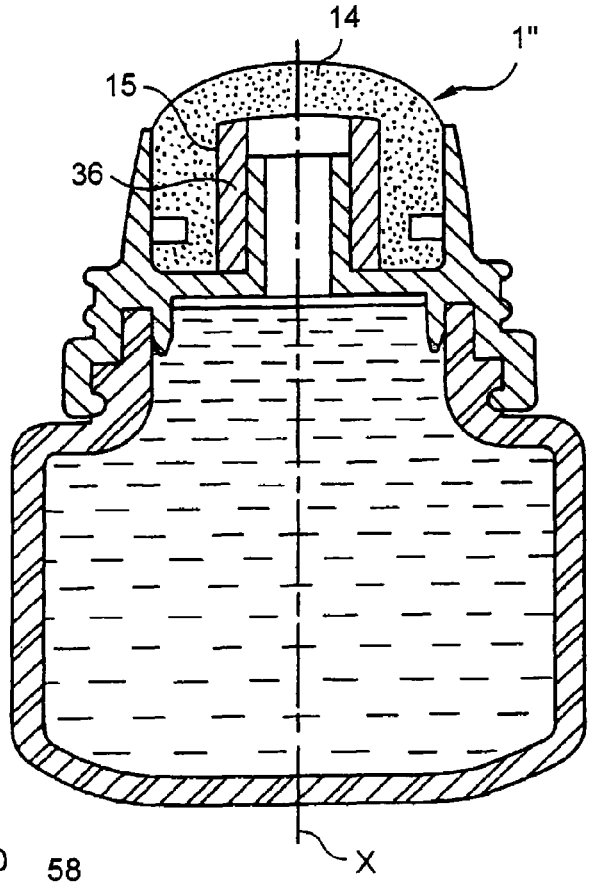

FIG. 7 shows an exemplary applicator device 1" that is substantially similar to the exemplary device 1 described above, and may include a resilient return member 36 made of a cellular material, and including a tubular shape, for example, such as a substantially circularly-cylindrical shape of axis X, extending over substantially the entire height of the recess 15, for example.

The resilient return member 36 and the applicator member 14 may advantageously be made of different materials, with a stiffer material being selected for the resilient return member 36.

It is contemplated that the applicator member may be secured to the closure cap, which thus defines a handle for the applicator member.

Figure 8:
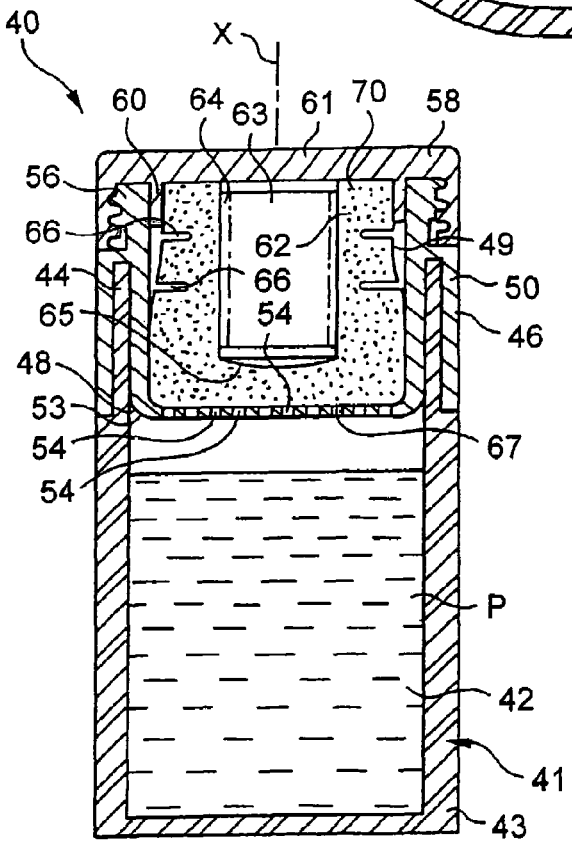
FIG. 8 is a diagrammatic and fragmentary axial-section view of another exemplary applicator device.

FIG. 8 shows an exemplary applicator device 40 constituting another exemplary embodiment.

The exemplary device 40 may include a receptacle 41 including an inside space 42 containing a substance P.

The receptacle 41 may comprise a body 43 provided with a neck 44 of axis X, onto which an insert 46 may be mounted. The insert 46 may comprise a dish 48 that defines a housing 49, and an assembly skirt 50 surrounding the dish 48, which enables the insert 46 to be fastened onto the neck 44.

The dish 48 may comprise a perforated wall 53 through which there passes at least one orifice, or a plurality of orifices 54 as in the exemplary embodiment shown, and an outer skirt 56 that is threaded on an outside thereof, which enables a closure cap 58 to be fastened by screw-fastening. Alternatively, the dish 48 and the cap 58 may be configured to enable some other form of fastening, for example, snap-fastening.

In the exemplary embodiment shown, the cap 58 may include a sealing lip 60 configured to bear against an inside surface of the skirt 56, when the cap 58 is fastened on the receptacle 41.

In the exemplary embodiment shown, the cap 58 may carry an applicator member 62 that is made of foam, for example, polyurethane foam.

The applicator member 62 may include a portion 70 that is secured to the inside face of the top wall 61 of the cap 58, for example, by adhesive or heat sealing.

The applicator member 62 may include a recess 63 of axis X, closed at a bottom thereof by an end wall 65. A resilient return member 64 may be disposed in the recess 63 and may bear against the end wall 65.

In the exemplary embodiment shown, the resilient return member 64 may comprise a helical spring working in compression. Alternatively (not shown), the resilient return member may comprise a foam that fills the entire recess, for example.

A plurality of peripheral annular grooves 66 that are parallel to one another and transverse to the axis X may be formed in the applicator member 62, so as to form zones of preferred deformation.

The applicator member 62 may include an application surface 67 configured to apply the substance.

When the closure cap 58 is fastened on the receptacle 41, the applicator member 62 may be compressed in the housing 49, with the application surface 67 bearing against the perforated wall 53.

To load the applicator member 62 with substance P, it is possible firstly to fasten the cap 58 onto the receptacle 41, and then to turn the receptacle 41 upsidedown or to shake the receptacle 41, so as to enable substance P to flow toward the application surface 67, via the orifices 54.

In the exemplary embodiment shown, it is also possible to load the applicator member 62 without fastening the cap 58 onto the receptacle 41.

Figure 9:
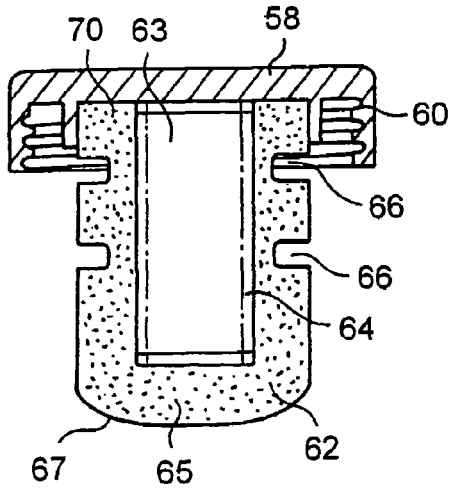
FIG. 9 is a diagrammatic and fragmentary axial-section view of an exemplary applicator member of the exemplary device of FIG. 8.

As shown in FIG. 9, when the cap 58 is removed from the receptacle 41, the applicator member 62 may include a height along the axis X that is relatively tall, so that the application surface 67 may easily be brought into contact with the perforated wall 53 of the dish 48, without having to screw the cap 58 onto the receptacle 41.

To apply substance P to skin, the user may use the cap 58 as a handle for the applicator member 58.

Naturally, the invention is not limited to the embodiments described above.

For example, the resilient return member, such as the spring 19, need not be disposed in a recess of the applicator member, but may be disposed around a portion of said applicator member, the resilient return member coming to bear on an outer shoulder of the applicator member, for example.

Throughout the description, including in the claims, the expression "comprising a" should be understood as being synonymous with the expression "comprising at least one", unless specified to the contrary.

Although various details of the present invention herein have been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. An applicator device for applying a substance, the device comprising:

a receptacle comprising an inside space containing a supply of a substance;

an applicator member comprising a cellular material that deforms at least in part during application, an application surface configured to apply the substance, and a recess presenting an end wall;

a handle defined by the receptacle and secured to the applicator member, the applicator member comprising at least one portion fastened relative to the handle;

a housing configured to receive the applicator member at least in part, the housing and the recess communicating in a permanent manner with the inside space containing the supply of the substance even when the applicator is not used for applying the substance; and a resilient return member configured to exert thrust on the end wall toward the application surface.

2. A device according to claim 1, wherein at least part of the applicator member is elastically deformable.

3. A device according to claim 2, wherein the resilient return member comprises a spring.

4. A device according to claim 1, wherein the resilient return member comprises a spring.

5. A device according to claim 4, wherein the spring is selected from one of the following elements: a single helix spring, a double helix spring, and a conical spring.

6. A device according to claim 1, wherein the resilient return member comprises a cellular material.

7. A device according to claim 6, wherein the resilient return member comprises a foam.

8. A device according to claim 6, wherein the resilient return member is permeable to the substance.

9. A device according to claim 6, wherein the resilient return member comprises a tubular wall.

10. A device according to claim 1, wherein the resilient return member is configured to return to an initial shape thereof after being compressed to a greater degree than the applicator member.

11. A device according to claim 1, wherein the resilient return member and the applicator member are made of different materials.

12. A device according to claim 1, further comprising a support carrying the applicator member, wherein the resilient return member is fastened on the support.

13. A device according to claim 1, further comprising a support carrying the applicator member, wherein the resilient return member is made integrally as a single piece with the support.

14. A device according to claim 1, wherein the resilient return member includes biocidal properties.

15. A device according to claim 1, further comprising a closure cap configured to close the housing.

16. A device according to claim 15, wherein the cap is configured to compress the applicator member at least in part, when the housing is closed by the cap at least in part.

17. A device according to claim 1, wherein the receptacle comprises a support carrying the applicator member, and wherein the support comprises at least one orifice configured to enable the substance to pass from the inside space to the applicator member.

18. A device according to claim 17, wherein the support comprises a chimney communicating with the orifice and extending at least in part into the housing.

19. A device according to claim 18, wherein the chimney forms an annular space in a recess of the applicator member, the resilient return member extending at least partially in said annular space.

20. A device according to claim 1, wherein the recess comprises a wall having a shape selected from: a cylindrical shape, and a frustoconical shape.

21. A device according to claim 20, wherein the recess comprises a wall having an egg shape.

22. A device according to claim 1, wherein the resilient return member extends at least in part into the recess of the applicator member.

23. A device according to claim 1, wherein the applicator member comprises a foam.

24. A device according to claim 23, wherein the applicator member is intrinsically permeable to the substance.

25. A device according to claim 1, wherein the applicator member is a single piece.

26. A device according to claim 1, wherein the applicator member includes at least one groove that extends substantially transversally to a direction in which the applicator member is compressed in use.

27. A device according to claim 26, wherein the groove comprises an annular groove.

28. A device according to claim 1, wherein the applicator member comprises at least one through orifice, opening to the application surface.

29. A device according to claim 28, wherein the applicator member comprises at least one slot opening out to the application surface.

30. A device according to claim 1, wherein, at least in a non-compressed state thereof, the applicator member includes a height that is greater than a largest transverse dimension thereof.

31. A device according to claim 1, further comprising a support carrying the applicator member, wherein the support comprises an outer skirt surrounding the applicator member at least in part, and wherein, in a non-compressed state thereof, the applicator member includes a height that is greater than a height of the skirt.

32. A device according to claim 31, wherein the applicator member, in the non-compressed state, includes a height that is at least 2% greater than the height of the skirt.

33. A device according to claim 31, wherein the applicator member, in the non-compressed state, includes a height that is at least 5% greater than the height of the skirt.

34. A device according to claim 31, wherein the applicator member, in the non-compressed state, includes a height that is at least 10% greater than the height of the skirt.

35. A device according to claim 31, wherein the applicator member, in the non-compressed state, includes a height that is at least 20% greater than the height of the skirt.

36. A device according to claim 31, comprising a closure cap configured to close the housing, wherein the outer skirt co-operates in a sealing manner with the cap when the housing is closed by said cap.

37. A device according to claim 1, wherein the substance comprises one of a cosmetic and a skincare product.

38. A device according to claim 1, wherein the applicator member comprises at a bottom portion an annular wall of thickness that decreases toward the bottom end of the applicator member.

39. An applicator device for applying a substance, the device comprising:

a receptacle comprising an inside space containing a supply of substance;

an applicator member that is deformable at least in part and secured to the receptacle, and comprising:

an application surface configured to apply the substance; and a recess including an end wall;

a housing configured to receive the applicator member at least in part;

a closure cap configured to close the housing, said housing and recess communicating, at least when the cap is in a closed position, with the inside space containing the supply of substance; and a resilient return member configured to exert thrust on the end wall toward the application surface.

* * * * *